US005401699A

United States Patent [19]

Ohashi et al.

[11] Patent Number: 5,401,699

[45] Date of Patent: Mar. 28, 1995

[54] HEAT-SENSITIVE RECORDING MATERIAL

[75] Inventors: Masanori Ohashi, Amagasaki; Tetsuo Tsuchida, Takarazuka; Kiyomi Okada, Osaka, all of Japan

[73] Assignee: Kanzaki Paper Manufacturing Co., Ltd., Tokyo, Japan

[21] Appl. No.: 111,174

[22] Filed: Aug. 24, 1993

[30] Foreign Application Priority Data

Aug. 31, 1992 [JP] Japan ..... 4-231223

[51] Int. Cl.[6] ..... B41M 5/18

[52] U.S. Cl. ..... 503/217; 503/216; 503/220; 503/221

[58] Field of Search ..... 427/150, 151; 503/216, 503/217, 220, 221

[56] References Cited

U.S. PATENT DOCUMENTS 4,502,066 2/1985 Satake et al. ..... 503/209

*Primary Examiner*—B. Hamilton Hess
*Attorney, Agent, or Firm*—Morgan & Finnegan

[57] ABSTRACT

The heat-sensitive recording material has on a base sheet a heat-sensitive recording layer which comprises a colorless or pale colored basic chromogenic material and a color developer. The recording layer comprises at least one fluoran derivative developing a black color and at least one azaphthalide derivative represented by the formula (I) as the basic chromogenic material, and at least one diphenylsulfone derivative represented by the formula (II) as the color developer. The azaphthalide derivative is used in an amount of 3 to 50 % by weight based on the amount of the fluoran derivative.

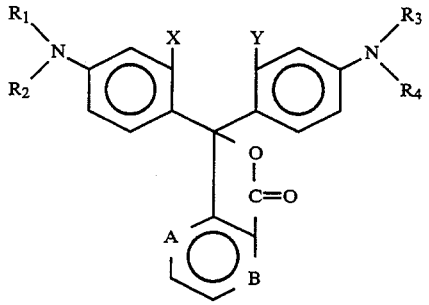

(I)

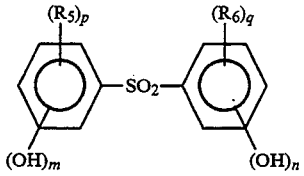

(II)

3 Claims, No Drawings

HEAT-SENSITIVE RECORDING MATERIAL

BACKGROUND OF THE INVENTION

The invention relates to a heat-sensitive recording material, particularly a heat-sensitive recording material in which the recorded images can be read with OCR (optical character reader) at a wave-length within the range of 600 to 700 nm.

There have been well-known heat-sensitive recording materials utilizing the colorforming reaction between a colorless or pale colored basic chromogenic material and an organic or inorganic color developer, in which the two colorforming materials are thermally contacted each other to produce recorded images. These heat-sensitive recording materials are comparatively inexpensive and can be used on a recording equipment which is compact and requires fairly easy maintenance. Because of these advantages, the heat-sensitive recording materials have been used not only as the recording medium of facsimiles and various computers, but also in the other various fields.

Recently, the application fields have been variously developed, and the requirements of the heat-sensitive recording material have been increased. As one of them, a heat-sensitive recording material developing black color images which can be read by OCR at a wave length within the range of 600 to 700 nm is required. Generally, basic chromogenic materials having a strong absorbing spectrum at a wave length within the range of 600 to 700 nm develop a blue color. Accordingly, such chromogenic materials are used together with basic chromogenic materials developing a black color to change the developed color to a black tone. However, in a heat-sensitive recording material using such a combination of chromogenic materials, fogging is generated on the white area during the storage. The improvement is strongly required.

An object of the invention is to provide a heat-sensitive recording material which develops a blue black color and in which the following PCS value at a wave length within the range of 600 to 700 nm is 0.8 or more, and each of the whiteness of the background and the color density of the recorded images is not substantially lowered after storing for a long time at high temperature and high humidity.

$$PCS=(R_L-R_D)/RL$$

$R_L$: reflective ratio of white bar and margin
$R_D$: reflective ratio of black bar

SUMMARY OF THE INVENTION

A heat-sensitive recording material according to the invention has on a base sheet a heat-sensitive recording layer which comprises a colorless or pale colored basic chromogenic material and a color developer. The recording layer comprises at least one fluoran derivative developing a black color and at least one azaphthalide derivative represented by the formula (I) as the basic chromogenic material, and at least one diphenylsulfone derivative represented by the formula (II) as the color developer. The azaphthalide derivative is used in an amount of 3 to 50 % by weight based on the amount of the fluoran derivative:

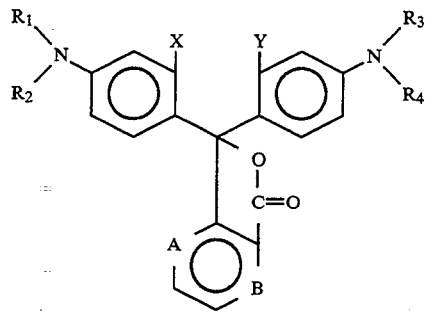

(I)

in which each of A and B is carbon or nitrogen atom, but at least one of them is nitrogen atom, each of $R_1$, $R_2$, $R_3$ and $R_4$ is hydrogen, alkyl, unsaturated alkyl, cycloalkyl, aryl, aralkyl or tetrahydrofurfuryl, the aryl and aralkyl may be substituted by at least one selected From the group consisting of halogen, alkyl and alkoxyl, and $R_1$ and $R_2$, or $R_3$ and $R_4$ may Form a ring with the neighboring nitrogen atom; and each of X and Y is hydrogen, halogen, alkyl, alkoxyl or acyloxy, but both of X and Y are not hydrogen atom;

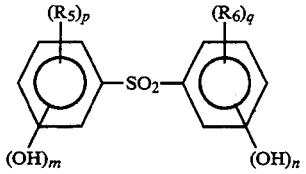

(II)

in which each of $R_5$ and $R_6$ is $C_1$–$C_4$ alkyl, $C_2$–$C_4$ alkenyl, $C_1$–$C_4$ alkoxyl, benzyloxy or halogen atom, m is 0, 1 or 2, n is an integer of 1 to 3 and each of p and q is 0, 1 or 2.

DETAILED DESCRIPTION OF THE INVENTION

As describe above, a heat-sensitive recording material according to the invention, which develops a blue black color and in which PCS value at a wave length of 600 to 700 nm is 0.8 or more and each of the whiteness of background and the color density of the recorded images is not substantially lowered after storing for a long time at high temperature and high humidity, can be obtained by using a mixture of black color developing fluoran derivatives and specific azaphthalide derivatives as the colorless or pale colored basic chromogenic material and diphenylsulfone derivatives as the color developer.

The specific azaphthalide derivatives is generally used in an amount of 3 to 50% by weight, preferably 5 to 30% by weight, more preferably 10 to 30% by weight based on the used amount of the black color developing fluoran derivatives.

By increasing the used amount of the basic chromogenic materials in the recording layer, PCS value is naturally increased, but the basic chromogenic material is preferably used in an amount of 0.2 to 1.0 g/m$^2$ in consideration of the recording sensitivity, discoloration of the background by exposing to light, and economy. Further, when the azaphthalide derivatives comprised in the recording layer is less than 3% by weight based on the amount of the fluoran derivatives, PCS value at a wave length of 600 to 700 nm becomes less than 0.8 and a desired blue black color image can not be obtained. To the contrary, when the azaphthalide derivatives is more than 50% by weight, the developed color becomes blue, and fogging is generated on the white area by the affection of humidity, temperature, light or the like. Resultantly, the commercial value is lowered.

As the black color developing fluoran derivatives used in the invention, there are exemplified 3-diethylamino-6-methyl-7-anilinofluoran, 3-diethylamino-6-methyl-7-toluidinofluoran, 3-diethylamino-6-methyl-7-xylidinofluoran, 3-diethylamino-6-methyl-7-mesidinofluoran, B-diethylamino-6-methyl-7-(p-butylanilino)-fluoran, 3-diethylamino-6-methyl-7-anisidinofluoran, 3-diethylamino-6-methyl-7-p-phenetidinofluoran, 3-dimethylamino-6-methyl-7-anilinofluoran, 3-dipropylamino-6-methyl-7-anilinofluoran, 3-di(β-ethoxyethyl)amino-6-methyl-7-anilinofluoran, 3-di(chloroethyl)amino-6-methyl-7-anilinofluoran, 3-dibenzylamino-6-methyl-7-anilinofluoran, B-(N-methyl-N-cyclohexylamino) -6-methyl-7-anilinofluoran, 3-(N-ethyl-N-cyclohexylamino) -6-methyl-7-anilinofluoran, 3-(N-allyl-N-n-pentylamino)-6-methyl-7-anilinoftuoran, 3-pyrrolidino-6-methyl-7-anilinofluoran, -piperidino-6-methyl-7-anilinofluoran, 3-piperidino-6-methyl-7-toluidinofluoran, 3-piperidino-6-methyl-7-(p-butylanilino)fluoran, 3-methylpiperidino-6-methyl-7-(p-butylanilino)fluoran, 3-morpholino-6-methyl-7-(p-butylanilino)fluoran, 3-(N-methylanilino)-6-methyl-7-anilinofluoran, 3-(N-ethylanilino)-6-methyl-7-anilinofluoran, 3-(N-benzylanilino)-6-methyl-7-anilinofluoran, 3-(N-ethyl-p-toluidino)-6-methyl-7-anilinofluoran, B-(N-ethyl-p-chloroanilino)-6-methyl-7-anilinofluoran, 3-(N-ethylanilino)-6-methyl-7-(p-toluidino)fluoran, 3-(N-ethyl-p-toluidino)-6-methyl-7-(p-toluidino)fluoran, 3-(N-benzylxylidino) -6-methyl-7-(p-toluidino)fluoran, 3-(N-chloroethyl-p-toluidino)-6-methyl-7-xylidinofluoran, 3-(N-ethylanilino)-6-methyl-7-(p-butylanilino)fluoran, 3-dibutylamino-6-methyl-7-anilinofluoran, 3-(N-methyl-N-propylamino) -6-methyl-7-anilinofluoran, 3-(N-ethyl-N-isopentylamino)-6-methyl-7-anilinofluoran, 3-(N-ethyl-N-n-hexylamino)-6-methyl-7-anilinofluoran, 3-hexamethyleneimino-6-methyl-7-anilinofluoran, 3-(2,3-dihydro-isoindole-2-yl)-6-methyl-7-anilinofluoran, 3-diethylamino-6-chloro-7-anilinofluoran, 3-diethylamino-6-bromo-7-anilinofluoran, 3-(N-ethyl-N-isobutylamino)-6-methyl-7-anilinofluoran, B-(N-methyl-N-tetrahydrofurfurylamino) -6-methyl-7-anilinofluoran, 3-(N-ethyl-N-tetrahydrofurfurylamino) -6-methyl-7-anilinofluoran, 3-diethylamino-1,6-dimethyl-7-anilinofluoran, 3-diethylamino-4-chloro-6-methyl-7-anilinofluoran, 3-diethylamino-7-(o-chloroanilino)fluoran, 3-dibutylamino -7-(o-chloroanilino)fluoran, 3-(N-ethyl-N-hexylamino)-7-(o-chloroanilino)fluoran, 3-(N-ethyl-N-isopentylamino)-7-(o-chloroanilino)fluoran, 3-diethylamino-7-(o-bromoanilino)fluoran, 3-dibutylamino-7-(o-fluoroanilino)fluoran, 3-diethylamino-7-(o-methoxycarbonylphenylamino)fluoran, 3-diethylamino-7-[o-(isopentyloxycarbonyl)phenylamino]fluoran, 3-diethylamino-5,6-dimethyl-7-anilinofluoran, 3-diethylamino-5-chloro-6-methyl-7-anilinofluoran, 3-dibutylamino-6-methyl-7-(p-chloroanilino)fluoran, 3-diethylamino-7-(m-trifluoromethylanilino)fluoran, 3-dibutylamino-7-(p-trifluorlmethylanilino)fluoran, 3-diethylamino -5-methyl-7-(m-trifluoromethylanilino)fluoran, 3-diethylamino-5-ethyl -7-(m-trifluorlmethylanilino)fluoran, 3-(N-ethyl-N-cyclopentylamino) -6-methyl-7-anilinofluoran, 3-diethylamino-5-chloro-7-(m-trifluoromethylanilino)fluoran, 3-dipentylamino-6-methyl-7-anilinofluoran, 3-(N-etyl-N-ethoxypropylamino)-6-methyl-7-anilinofluoran, 3-(N-methyl-N-ethoxypropylamino) -6-methyl-7-anilinofluoran and the like.

Further, the azaphthalide derivatives represented by the formula (I), which are used with the above fluoran derivatives, are chromogenic materials developing a blue color in a high color density when they are used solely. Among them, there are exemplified dimethylaminophenyl)-3-(4-dimethylamino-2-methylphenyl)-4-azaphthalide, 3-(4-dimethylaminophenyl)-3-(4-dimethylamino-2-methylphenyl)-7-azaphthalide, 3-(4-dimethylaminophenyl)-3-(4-diethylamino-2-methylphenyl) -4-azaphthalide, 3-(4-dimethylaminophenyl)-3-(4-diethylamino-2-methylphenyl) -7-azaphthalide, 3-(4-dimethylaminophenyl)-3-(4-diethylamino -2-methylphenyl)-4,7-diazaphthalide, 3-(4-dimethylaminophenyl)-3-(4-dibutylamino-2-methylphenyl) -4-azaphthalide, 3-(4-dimethylaminophenyl) -3-(4-diallylamino-2-methylphenyl)-4-azaphthalide, 3-(4-dimethylaminophenyl) -3-(4-N-methyl-N-allylamino-2-methylphenyl)-4-azaphthalide, 3-(4-dimethylaminophenyl)-3-(4-dipropagylamino-2-methylphenyl) -4-azaphthalide, 3-(4-dimethylaminophenyl)-3-(4-propagylamino -2-methylphenyl)-4-azaphthalide, 3-(4-dimethylaminophenyl)-3-(4-N-methyl-N-propagylamino -2-methylphenyl)-a-azaphthalide, 3-(4-dimethylaminophenyl) -3-(4-N-methyl-N-cyclohexylamino-2-methylphenyl)-4-azaphthalide, 3-(4-dimethylaminophenyl)-3-(4-N-ethyl-p-toluidino-2-methylphenyl) -4-azaphthalide, 3-(4-dimethylaminophenyl)-3-(4-N-methyl-N-benzylamino -2-methylphenyl)-4-azaphthalide, 3-(4-dimethylaminophenyl)-3-(4-N-ethyl-N-tetrahydrofurfurylamino-2-methylphenyl)-4-azaphthalide, 3-(4-dimethylaminophenyl)-3-(2-N-methyl-N-ethoxymethylamino-2-methylphenyl) -4-azaphthalide, 3-(4-dimethylaminophenyl)-3-(4-N-methyl-N-ethoxymethylamino -2-methylphenyl)-7-azaphthalide, 3-(4-dimethylaminophenyl) -3-(4-dimethylamino-2-ethylphenyl)-4-azaphthalide, 3-(4-dimethylaminophenyl) -3-(4-diethylamino-2-ethylphenyl)-2-azaphthalide, 3-(4-dimethylaminophenyl)-3-(4-diethylamino-2-isobutylphenyl)-4-azaphthalide, 3-(4-dimethylaminophenyl)-3-(4-diethylamino-2-methoxyphenyl) -4-azaphthalide, 3-(4-dimethylaminophenyl)-3-(4-diethylamino-2-methoxyphenyl) -7-azaphthalide, 3-(4-dimethylaminophenyl)-3-(4-diethylamino -2-ethoxyphenyl)-4-azaphthalide, 3-(4-dimethylaminophenyl)-3-(2-diethylamino -2-ethoxyphenyl)-7-azaphthalide, 3-(4-dimethylaminophenyl)-3-(4-diethylamino-2-acetoxyphenyl)-4-azaphthalide, 3-(4-dimethylaminophenyl) -3-(4-diethylamino-2-chlorophenyl)-4-azaphthalide, 3-(4-diethylaminophenyl) -3-(4-dimethylamino-2-methylphenyl)-4-azaphthalide, 3-(4-diethytaminophenyl) -3-(4-dimethylamino-2-methylphenyl)-7-azaphthalide, 3-(4-diethylaminophenyl)-3-(4-diethylamino-2-methylphenyl)-2-azaphthalide, 3-(4-diethylaminophenyl )-3-(4-diethylamino-2-methylphenyl)-7-azaphthalide, 3-(4-dibutylaminophenyl )-3-(4-diethylamino-2-methylphenyl)-4-azaphthalide, 3-N-methyl-N-cyctohexylaminophenyl )-3-(4-diethylamino-2-methylphenyl)-4-azaphthalide, 3-(4-N-ethyl-N-isopentylaminophenyl)-3-(4-diethylamino-2-methylphenyl) -4-azaphthalide, 3-(4-N-ethyl-N-cyclopentylaminophenyl)-3-(4-diethylamino-2-methylphenyl)-4-azaphthalide, 3-(4-piperidinophenyl)-3-(4-diethylamino-2-methylphenyl)-4-azaphthalide, 3-(4-pyrrolidinophenyl)-3-(4-diethylamino-2-methytphenyl)-4-azaphthalide, 3,3-b is(4-dimethylamino -2-methylphenyl)-4-azaphthalide, 3,3-bis(4-dimethylamino-2-methytphenyl) -7-azaphthalide, 3,3-bis(4-diethylamino-2-methylphenyl)-4-azaphthalide, 3,3-bis(4-diethylamino-2-methylphenyl)-7-azaphthalide, 3,3-bis(4-diethylamino-2-methylphenyl)-4,7-diazaphthalide, 3,3-bis(4-diethylamino -2-ethylphenyl)-4-azaphthalide, 3-(4-dimethylaminophenyl) -3-(4-dimethylamino-2-methoxyphenyl)-4-azaphthalide, 3-(4-dimethylaminophenyl) -3-(4-dimethylamino-2-methoxyphenyl)-7-azaphthalide, 3-(4-diethylaminophenyl)-3-(4-dimethylamino-2-methoxyphenyl)-4-azaphthalide, 3-(4-diethylaminophenyl)-3-(4-diethylamino-2-methoxyphenyl) -4-azaphthalide, 3-(4-diethylaminophenyl)-3-(4-diethylamino-2-methoxyphenyl) -7-azaphthalide, 3-(4-dimethylamino-2-methylphenyl)-3-(4-dimethylamino -2-ethoxyphenyl)-4-azaphthalide, 3-(4-dimethylamino-2-methylphenyl)-3-(4-diethylamino-2-ethoxyphenyl)-4-azaphthalide, 3-(4-diethylamino-2-methylphenyl)-3-(4-dimethylamino-2-ethoxyphenyl)-4-azaphthalide, 3-(4-diethylamino-2-methylphenyl)-3-(4-diethylamino-2-ethoxyphenyl) -4-azaphthalide, 3-(4-dimethylaminophenyl)-3-(4-dimethylamino -2-ethoxyphenyl)-4-azaphthalide, 3-(4-dimethylaminophenyl)-3-(4-dimethylamino -2-ethoxyphenyl)-7-azaphthalide, 3-(4-diethylaminophenyl) -3-(4-dimethylamino-2-ethoxyphenyl)-4-azaphthalide, 3-(4-diethytaminophenyl) -3-(4-diethylamino-2-ethoxyphenyl)-4-azaphthalide, 3-(4-diethylaminophenyl)-3-(4-diethylamino-2-ethoxyphenyl)-7-azaphthalide, 3-(4-dimethylamino-2-methoxyphenyl)-3-(4-dimethylamino-2-chlorophenyl)-4-azaphthalide, 3-(4-dimethylamino-2-methoxyphenyl)-3-(4-diethylamino-2-chlorophenyl)-4-azaphthalide, 3-(4-diethylamino-2-methoxyphenyl)-3-(4-dimethytamino-2-chlorophenyl)-4-azaphthalide, 3-(4-diethylamino-2-methoxyphenyl)-3-(4-diethylamino-2-chlorophenyl)-4-azaphthalide, 3-bis(4-dimethylamino-2-methoxyphenyl)-4-azaphthalide, 3,3-bis(4-dimethylamino-2-methoxyphenyl)-7-azaphthalide, 3-(4-dimethylamino -2-methoxyphenyl)-3-(4-diethylamino-2-methoxyphenyl)-4-azaphthalide, 3-(4-dimethylamino-2-methoxyphenyl)-3-(4-diethylamino-2-methoxyphenyl)-7-azaphthalide, 3,3-bis(4-diethylamino-2-methoxyphenyl)-4-azaphthalide, 3,3-bis(4-diethylamino-2-methoxyphenyl)-7-azaphthalide, 3,3-bis(4-diethylamino -2-methoxyphenyl)-4,7-diazaphthalide, 3,3-bis(4-dimethylamino -2-ethoxyphenyl)-4-azaphthalide, 3,3-bis(4-dimethylamino-2-ethoxyphenyl) -7-azaphthalide, 3,3-bis(4-dimethylamino-2-ethoxyphenyl)-4,7-diazaphthalide, 3-(4-dimethylamino-2-ethoxyphenyl)-3-(4-diethylamino-2-ethoxyphenyl)-4-azaphthalide, 3-(4-dimethylamino-2-ethoxyphenyl)-3-(4-diethylamino-2-ethoxyphenyl)-7-azaphthalide, 3,3-bis(4-diethylamino-2-ethoxyphenyl)-4-azaphthalide, 3,3-bis(4-diethylamino-2-ethoxyphenyl)-7-azaphthalide, 3,3-bis(4-diethylamino-2-ethoxyphenyl)-4,7-diazaphthalide, 3,3-bis(4-dimethylamino-2-ethylphenyl)-4-azaphthalide, -(4-dimethylamino-2-ethylphenyl)-3-(4-diethylamino-2-ethylphenyl)-4-azaphthalide, 3-(4-dimethylamino-2-methylphenyl)-3-(4-dimethylamino-2-methoxyphenyl) -4-azaphthalide, 3-(4-dimethylamino-2-methylphenyl)-3-(4-diethylamino-2-methoxyphenyl)-4-azaphthalide, 3-(4-diethylamino-2-methylphenyl) -3-(4-dimethylamino-2-methoxyphenyl)-4-azaphthalide, 3-(4-diethytamino-2-methylphenyl)-3-(4-diethylamino-2-methoxyphenyl)-4-azaphthalide, 3,3-bis(4-dimethylamino-2-chlorophenyl)-4-azaphthalide, 3-(4-dimethylamino-2-methytphenyl)-3-(4-diethylamino-2-methylphenyl)-4-azaphthalide, 3-(4-diethylaminophenyl)-3-(4-dimethylamino-2-chlorophenyl) -7-azaphthalide, 3,3-bis(4-dibutylamino-2-methoxyphenyl)-4-azaphthalide, 3,3-bis(N-ethyl-p-toluidino-2-methoxyphenyl)-4-azaphthalide, 3-(4-dibenzylaminophenyl)-3-(4-diethylamino-2-ethoxyphenyl) -n-azaphthalide, 3-(4-dimethylaminophenyl)-3-(4-diethylamino-2-hexyloxyphenyl)-4-azaphthalide and the like. Naturally, the azaphthalide derivatives are not restricted within the above compounds, and they may be used, if necessary, in combination of two or more. Among them, there are most preferably used 3,3-bis(4-diethylamino-2-ethoxyphenyl) -4-azaphthalide, 3,3-bis(4-diethylamino-2-methoxyphenyl)-4-azaphthalide, 3-(4-dimethylaminophenyl)-3-(4-diethylamino-2-methylphenyl)-4-azaphthalide, 3-(4-diethylaminophenyl)-3-(4-dimethylamino-2-chlorophenyl) -7-azaphthalide, 3,3-bis(4-dibutylamino-2-methoxyphenyl)-4-azaphthalide, 3,3-bis(N-ethyl-p-toluidino-2-methoxyphenyl)-4-azaphthalide, 3-(4-dibenzylaminophenyl)-3-(4-diethylamino-2-ethoxyphenyl) -4-azaphthalide and 3-(4-dimethylaminophenyl)-3-(4-diethylamino-2-hexyloxyphenyl)-4-azaphthalide.

In the heat-sensitive recording materials according to the invention, the specific fluoran derivative and azaphthalide derivative as described above are used together in a specific ratio. By using a diphenylsulfone derivative represented by the formula (II) as a color developer together with them, a good effect for preventing fogging can be obtained. As the diphenylsulfone derivatives, there are exemplified 4,4'-dihydroxydiphenylsulfone, 2,4'-dihydroxydiphenylsulfone, 3,3'-diallyl -4,4'-dihydroxydiphenylsulfone, 3,3',5,5'-tetrabromo-4,4'-dihydroxydiphenylsulfone, 3,3',5,5'-tetrachloro-4,4'-dihydroxydiphenylsulfone, 4-hydroxydiphenylsulfone, 4-hydroxy-4'-methyldiphenylsulfone, 44-hydroxy-3',4'-tetramethylenediphenylsulfone, 4-hydroxy-4'-methoxydiphenylsulfone, 4-hydroxy-4'-ethyoxydiphenylsulfone, 4-hydroxy-4'-n-butoxydiphenylsulfone, '-hydroxy, 4'-benzyloxydiphenylsutfone, 3,4-dihydroxydiphenylsulfone, 3,4-dihydroxy-4'-methyldiphenylsulfone, 3,4,4'-trihydroxydiphenylsulfone, 3,4,3',4'-tetrahydroxydiphenylsulfone, 2,3,4-trihydroxydiphenylsulfone and the like. They may be used either solely or in combination.

Among the diphenylsulfone derivatives, 2,4'-dihydroxydiphenylsulfone and 4-hydroxy-4'-isopropoxydiphenylsulfone are preferably used because of producing a heat-sensitive recording material very superior in recording sensitivity and antifogging.

In the invention, the diphenylsulfones as described above are selectively used as the color developer, but any other known color developer may be used together so far as the desired advantages are not checked.

As the known color developers, there are exemplified inorganic acidic substances such as activated clay, attapulgite and aluminum silicate, and organic acidic substances such as phenolic compounds, e.g., 4-tert-butylphenol, α-naphthol, β-naphthol, 4-tert-octylphenol, 2,2'-dihydroxydiphenol, 4,4'-isopropylidenebis(2-tert-butylphenol), 4,4'-sec-isopropylidenediphenol, 4-phenylphenol, 4,4'-isopropylidenediphenol, 4,4'-dihydroxydiphenylmethane, 4,4'-(1,3-dimethylbutylidene)-bisphenol, 4,4'-thiobis(6-tert-butyl-3-methylphenol), 2,2-bis(4-hydroxyphenyl)-4-methylpentane, 2,2'-methylenebis(4-chlorophenol), 4,4'-cyclohexylidenediphenol, 4,4'-dihydroxydiphenylsulfide, hydroquinone monobenzyl ether, 4-hydroxybenzophenone, 2,4-dihydroxybenzophenone, 2,4,4'-trihydroxybenzophenone, dimethyl 4-hydroxyphthalate, methyl 4-hydroxybenzoate, propyl 4-hydroxybenzoate, sec-butyl 4-hydroxybenzoate, pentyl 4-hydroxybenzoate, phenyl 4-hydroxybenzoate, benzyl 4-hydroxybenzoate, tolyl 4-hydroxybenzoate, chlorophenyl 4-hydroxybenzoate, phenylpropyl 4-hydroxybenzoate, phenethyl 4-hydroxybenzoate, p-methoxybenzyl 4-hydroxybenzoate, p-hydroxy-N-(2-phenylethyl)benzenesulfonamide, dimethyl 4-hydroxyphthalate, 1,5-bis(4-hydroxyphenylthio)-3-oxa-pentane, novolak phenol resins, phenolic polymers and the like; aromatic carboxylic acids, e.g., p-tert-butylbenzoic acid, 3-sec-butyl-4-hydroxybenzoic acid, 3-cyclohexyl-4-hydroxybenzoic acid, 3,5-dimethyl-4-hydroxybenzoic acid, 3-benzylsalicylic acid, 3-(α-methylbenzyl)salicylic acid, 3-chloro-5-(α-methylbenzyl)salicylic acid, 3,5-di-tert-butylsalicylic acid, 3-phenyl-5-(α,α-dimethylbenzyl)salicylic acid, 3,5-di-α-methylbenzylsalicylic acid and the like; sulfide derivatives, e.g., bis(3-tert-butyl-4-hydroxy-6-methylphenyl)-sulfide, bis(2-methyl-4-hydroxy-6-tert-butylphenyl)sulfide and the like; salts of the above phenol compounds and aromatic carboxylic acids with polyvalent metals, e.g., Zn, Mg, Al, Ca, Ti, Mn, Sn, Ni and the like; and organic acid compounds such as complex of antipyrine with zinc thiocyanate.

The heat-sensitive recording materials according to the invention may be produced by coating on a base sheet a coating composition generally produced by dispersing finely divided particles of chromogenic materials comprising a fluoran derivative and an azaphthalide derivative represented by the formula (I) and a color developer comprising a diphenylsulfone derivative represented by the formula (II) in a medium in which a binder is dissolved or dispersed.

The proportion of the colorless or pale colored basic chromogenic material to the color developer used in the recording layer according to the invention is not limited to any particular values. Generally, 1 to 10 parts by weight, preferably 2 to 5 parts by weight of the color developer is used per part by weight of the basic chromognic material.

A coating composition containing these substances may be prepare by dispersing a chromogenic material and a color developer, either as an admixture or independently, in a dispersion medium, which is typically water, by means of a suitable stirrer or grinder such as a ball mill, an attritor or a sand mill.

The coating composition generally comprises at least one binder, such as starches, hydroxyethyl cellulose, methyl cellulose, carboxymethyl cellulose, gelatin, casein, gum arabic, polyvinyl alcohol, salts of styrene-maleic arthydride copolymer, salts of styrene-acrylic acid, emulsion of styrene-butadiene copolymer or the like. The used amount of the binder is generally 10 to 20% by weight, preferably 15 to 35% by weight based on the total solid of the coating composition.

The coating composition may contain various additives such as dispersing agents, e.g., sodium dioctylsulfosuccinate, sodium dodecylbenzenesulfonate, sodium lauryl sulfate and metal salts of fatty acids; ultraviolet absorbers, e.g., triazole derivatives; defoaming agents; fluorescent dyes; coloring dyes; and antioxidants. Further, there may be added to the coating composition a dispersion or emulsion of such as stearic acid, polyethylene, carnauba wax, paraffine wax, zinc stearate, calcium stearate, ester wax and the like to prevent the generation of sticking by contacting the heat-sensitive recording material with a recorder or recording head.

Further, in the heat-sensitive recording material according to the invention, there may be added to the recording layer a modifier for improving the recording sensitivity such as caproic acid amide, captic amide, palmitic acid amide, stearic acid amide, oleic amide, erucic amide, linoleic acid amide, N-methyl stearic acid amide, stearic acid anilide, N-methyl oleic amide, benzanilide, linoleic acid anilide, N-ethyl capric amide, N-butyl lauric acid amide, N-octadecyl acetamide, N-oleyl acetamide, N-oleyl benzamide, N-stearyl cyclohexylamide, polyethylene glycol, 1-benzyloxynaphthalene, 2-benzyloxynaphthalene, phenyl 1-hydroxynaphthoate, 1,2-diphenoxyethane, 1,4-diphenoxybutane, 1,2-bis(3-methylphenoxy)ethane, 1,2-bis(4-methoxyphenoxy)ethane, 1-phenoxy-2-(4-chlorophehoxy)ethane, 1-phenoxy-2-(4-methoxyphenoxy)ethane, 1-(2-methylphenoxy)-2-(4-methoxyphenoxy)ethane, dibenzy terephthalate, dibenzyl oxalate, di(4-methylbenzyl) oxalate, benzyl p-benzyloxybenzoate, p-benzylbiphenyl, 1,5-bis(p-methoxyphenoxy)-3-oxapentane, 1,4-bis(2-vinyloxyethoxy)benzene, p-biphenyl p-tolyl ether, benzyl p-methylthiophenyl ether, 2-(2'-hydroxy-5'-methylphenyl)benzotriazole, 2-hydroxy-4-benzyloxybenzophenone and the like.

The used amount of the modifier for improving the recording sensitivity is not particularly limited, but it is generally within the range of 30 to 1000 parts by weight, preferably 50 to 500 parts by weight based on 100 parts by weight of the chromogenic material. Further, in order to improve the smudge-adhering phenomena to recording head, inorganic pigments such as kaolin, clay, talc, calcium carbonate, calcined clay, titanium oxide, diatomaceous earth, finely divided anhydrous silica, activated clay and the like.

As the base sheet, there may be used paper, plastic film, synthetic paper, or laminated paper prepared by bonding a plastic film or synthetic paper to paper or wood free paper with an adhesive or coating a plastic resin on paper.

As the plastic films, there are exemplified polyethylene, polyester, polyvinyl chloride, polystyrene, polyamide films. As the synthetic paper, there may be used that made by a film method or fiber method. As the film method., there is exemplified an additive method in which a mixture of a resin with a filler and additives is fused and extrude to form a film, a surface-coating method in which a pigment coating layer is formed on a film, a surface-treating method or the like. As the synthetic paper made by a fiber method, there may be synthetic pulp paper, spanbonded paper or the like.

Among them, plastic films and synthetic paper manufactured by a film method are preferably used, because particularly superior advantages of the invention can be obtained.

The coating method for preparing a recording layer is not particularly limited and various known methods may be applied. For example, the recording layer may be formed by applying the coating composition with a coater such as bar coater, air-knife coater, rod-blade coater, pure-blade coater, short dwell coater or the like, and drying it. When a plastic film is used as the base sheet, the coating adaptability can be increased by treating the base sheet with corona. discharge, electron beam irradiation or the like. The amount of the coating composition is not particularly limited, but it is generally within the range of 2 to 10 g/m$^2$, preferably 3 to 7 g/m$^2$, on dry basis.

Further a protective layer comprising binders, lubricants, pigments and the like may be formed on the recording layer to obtain a heat-sensitive recording material superior in resistance to chemicals such as plasticizer, oil and the like.

As the binders used for producing the protective layer, there are exemplified polyvinyl alcohols having various saponification values, acetoacetyl-modified polyvinyl alcohols, carboxy-modified polyvinyl alcohols, silicon-modified polyvinyl alcohols, acryl resins, polyurethane resins and the like. The binder is used in an amount of generally about 10 to about 95% by weight, preferably about 30 to about 90% by weight, based on the total solid amount of the protective layer.

The coating amount of the protective layer is generally within the range of 0.5 to 10 g/m$^2$, preferably 1 to 7 g/m$^2$, on dry basis.

Further, a coating composition comprising a water-soluble, aqueous dispersible, electron beam-curable or ultra violet light-curable resin may be applied on the protective layer to give a high gloss. A protective layer may be formed on the back of the base sheet and an undercoating layer comprising a pigment and a binder may be formed between the base sheet and the heat-sensitive recording layer. The other various known technics in the manufacture of heat-sensitive recording materials may be applied in the invention.

The heat-sensitive recording material according to the invention may be used as a pressure sensitive adhesive sheet by applying a pressure sensitive adhesive.

PREFERRED EMBODIMENTS OF THE INVENTION

The following examples serve to illustrate the invention in more detail although the invention is not limited to the examples. Unless otherwise indicated, parts and % signify parts by weight and % by weight, respectively.

EXAMPLE 1

1) Preparation of Dispersion A

The following composition was pulverized by a sand mill until an average particle size of 1.5 microns.

| | |
|---|---|
| 3,3-bis(4-diethylamino-2-ethoxyphenyl)-4-azaphthalide | 2 parts |
| 3-dibutylamino-6-methyl-7-anilinofluoran | 10 parts |
| methyl cellulose (5% aqueous solution) | 5 parts |
| water | 40 parts |

2) Preparation of Dispersion B

The following composition was pulverized by a sand mill until an average particle size of 1.5 microns.

| | |
|---|---|
| 4-hydroxy-4'-isopropoxydiphenylsulfone | 20 parts |
| methyl cellulose (5% aqueous solution) | 5 parts |
| water | 55 parts |

3) Preparation of Dispersion C

The following composition was pulverized by a sand mill until an average particle size of 1.5 microns.

| | |
|---|---|
| 1,2-bis(3-methylphenoxy)ethane | 20 parts |
| methyl cellulose (5% aqueous solution) | 5 parts |
| water | 55 parts |

4) Formation of a heat-sensitive recording layer

The following composition was mixed with stirring to obtain a coating composition.

| | |
|---|---|
| Dispersion A | 57 parts |
| Dispersion B | 80 parts |
| Dispersion C | 80 parts |
| pigment (silicon oxide having an oil adsorption of 180 ml/100 g) | 15 parts |
| 20% aqueous solution of oxidized starch | 50 parts |
| water | 10 parts |

The coating composition was coated on wood free paper of 50 g/m$^2$ in the weight of an amount of 4 g/m$^2$ on dry basis and dried to obtain a heat-sensitive recording material.

EXAMPLE 2

A heat-sensitive recording material was obtained in the same manner as in Example 1 except that the used amount of 3,3-bis(4-diethylamino -2-ethoxyphenyl)-4-azaphthalide was changed to 4 parts to prepare Dispersion A.

EXAMPLE 3

A heat-sensitive recording layer was formed in the same manner as in Example 1 except that synthetic paper of 50 g/m$^2$ (Yupo FPG-80 manufactured by Oji Yuka Goseishi Kabushiki Kaisha) was used as the base sheet instead of wood free paper of 50 g/m$^2$. Further, the following coating composition was coated on the heat-sensitive recording layer in an amount of 4 g/m$^2$ on dry basis and dried to obtain a heat-sensitive recording layer having a protective layer.

| | |
|---|---|
| 10% aqueous solution of silicon-modified polyvinyl alcohol | 40 parts |
| kaolin | 40 parts |
| 30% aqueous emulsion of zinc stearate | 5 parts |
| water | 40 parts |

EXAMPLE 4

A heat-sensitive recording material was obtained in the same manner as in Example 3 except that 20 parts of 2,4'-dihydroxydiphenylsulfone was used instead of 20 parts of 4-hydroxy-4'-isopropoxydiphenylsulfone to prepare Dispersion B.

EXAMPLE 5

A heat-sensitive recording material was obtained in the same manner as in Example 3 except that 20 parts of 4,4'-dihydroxydiphenylsulfone was used instead of 20 parts of 4-hydroxy--4'-isopropoxydiphenylsulfone to prepare Dispersion B.

EXAMPLE 6

A heat-sensitive recording material was obtained in the same manner as in Example 3 except that 20 parts of 4-hydroxy-4'-methoxydiphenylsulfone was used instead of 20 parts of 4-hydroxy-4'-isopropoxydiphenylsulfone to prepare Dispersion B.

EXAMPLES 7–14

Eight hear-sensitive recording materials were obtained in the same manner as in Example 3 except that the following azaphthalide derivatives were used instead of 3,3-bis(4-diethylamino-2-ethoxyphenyl)-4-azaphthalide to prepare Dispersion A.

[Example 7] 3,3-bis(4-diethylamino-2-methoxyphenyl)-4-azaphthalide

[Example 8] 3,3-bis(4-dibutylamino-2-methoxyphenyl)-4-azaphthalide

[Example 9] 3,3-bis(4-diethylamino-2-methylphenyl)-4-azaphthalide

[Example 10] 3-(4-dimethylaminophenyl)-3-(4-diethylamino-2-methylphenyl)-4-azaphthalide

[Example 11] 3-(4-diethylaminophenyl)-3-(4-dimethylamino-2-chlorophenyl)-7-azaphthalide

[Example 12] 3,3-bis(N-ethyl-p-toluidino-2-methoxyphenyl)-4-azaphthalide

[Example 13] 3-(4-dibenzylaminophenyl)-3-(4-diethylamino-2-ethoxyphenyl)-4-azaphthalide

[Example 14] 3-(4-dimethylaminophenyl)-3-(4-diethylamino-2-hexyloxylphenyl)-4-azaphthalide

EXAMPLES 15–16

Two heat-sensitive recording materials were obtained in the same manner as in Example 3 except that the following fluoran derivatives were used instead of 3-dibutylamino-6-methyl-7-anilinofluoran to prepare Dispersion A.

[Example 15] 3-dibutylamino-7-(o-chloroanilino)fluoran

[Example 16] 3-(N-ethyl-N-isopentylamino)-6-methyl-7-anilinofluoran

COMPARATIVE EXAMPLE 1

A heat-sensitive recording material was obtained in the same manner as in Example 3 except that the used amount of 3,3-bis(4-diethylamino -2-ethoxyphenyl)-4-azaphthalide was reduced to 0.1 parts to prepare Dispersion A.

COMPARATIVE EXAMPLE 2

A heat-sensitive recording material was obtained in the same manner as in Example 1 except that the used amount of each of 3-dibutylamino -6-methyl-7-anilinofluoran and 3,3-bis(4-diethylamino-2-ethoxyphenyl) -4-azaphthalide was changed to 6 parts to prepare Dispersion A.

COMPARATIVE EXAMPLE 3

A heat-sensitive recording material was obtained in the same manner as in Example 1 except that 4,4'-isopropylidenediphenol was used instead of 4-hydroxy-4'-isopropoxydiphenylsulfone to prepare Dispersion B.

COMPARATIVE EXAMPLE 4

A heat-sensitive recording material was obtained in the same manner as in Example 1 except that the used amount of 3-dibutylamino-6-methyl-7-anilinofluoran was changed to 12 parts and 3,3-bis(4-diethylamino -2-ethoxyphenyl)-4-azaphthalide was not used to prepare Dispersion A.

COMPARATIVE EXAMPLE 5

A heat-sensitive recording material was obtained in the same manner as in Example 1 except that 3-dibutylamino-6-methyl-7-anilinofluoran was not used and the used amount of 3,3-bis(4-diethylamino-2-ethoxyphenyl) -4-azaphthalide was changed to 12 parts to prepare Dispersion A.

COMPARATIVE EXAMPLE 6

A heat-sensitive recording material was obtained in the same manner as in Example 1 except that 1-ethyl-8-dibutylamino-2,2,4-trimethyl -1,2-dihydrospiro[11H-chromeno(2,3-g)quinoline-11,3'-phthalide]was used instead of 3,3-bis(4-diethylamino-2-ethoxyphenyl)-4-azaphthalide to prepare Dispersion A.

Thus obtained 22 heat-sensitive recording materials were examined by the following methods. The results are shown in Table 1.

PCS Value

PCS value at 600–700 nm was measured by using UVIDEC 505 manufactured by Hippon Bunko Kogyo Kabushiki Kaisha.

Image-retainability

1) In the first, each of thus obtained heat-sensitive recording materials was recorded by a simulator for heat-sensitive recording (TH-PDM manufactured Ohkura Denki Kabushiki Kaisha) with a recording head energy of 0.3 mJ/dot. The color density of the recorded images was measured by Macbeth densitometer RD 914 manufactured by Macbeth Corporation.
2) In order to know heat-resistance of the recorded images, the heat-sensitive recording materials after recording images in the above method were allowed to stand for 24 hours at 60° C., and then the color density of the images was measured by Macbeth densitometer RD 914 manufactured by Macbeth Corporation.
3) In order to know moisture-resistance of the recorded images, the heat-sensitive recording materials after recording images in the above method were allowed to stand for 24 hours at 40° C.-94%RH, and then the color density of the images was measured by Macbeth densitometer RD 914 manufactured by Macbeth Corporation.

Fogging

1) In order to evaluate fogging, the whiteness of the recording surface of each heat-sensitive recording material was measured by Hunter multipurpose reflectometer.
2) In order to know heat-resistance of the whiteness, the heat-sensitive recording materials were allowed to stand for 24 hours at 60° C., and then the whiteness of the recording surface was measured by Hunter multipurpose reflectometer.
3) In order to know moisture-resistance of the whiteness, the heat-sensitive recording materials were allowed to stand for 24 hours at 40 ° C.-94%RH, and then the whiteness of the recording surface was measured by Hunter multipurpose reflectometer.

TABLE 1

| | | | Image-retainability -Color density- | | | Fogging -Whiteness (%)- | | |
|---|---|---|---|---|---|---|---|---|
| | Developed Color | PCS value at 600–700 nm | Original | Heat-resistance | Moisture resistance | Original | Heat-resistance | Moisture resistance |
| Examples | | | | | | | | |
| 1 | Blue Black | 0.82–0.85 | 1.28 | 1.23 | 1.21 | 84.3 | 79.0 | 81.5 |
| 2 | Blue Black | 0.84–0.87 | 1.29 | 1.25 | 1.22 | 84.1 | 78.5 | 81.2 |
| 3 | Blue Black | 0.88–0.94 | 1.37 | 1.29 | 1.24 | 85.8 | 82.1 | 83.9 |

TABLE 1-continued

| | Developed Color | PCS value at 600–700 nm | Image-retainability -Color density- | | | Fogging -Whiteness (%)- | | |
|---|---|---|---|---|---|---|---|---|
| | | | Original | Heat-resistance | Moisture resistance | Original | Heat-resistance | Moisture resistance |
| 4 | Blue Black | 0.86–0.91 | 1.34 | 1.28 | 1.21 | 85.9 | 82.0 | 84.1 |
| 5 | Blue Black | 0.82–0.85 | 1.26 | 1.20 | 1.19 | 85.4 | 80.3 | 81.8 |
| 6 | Blue Black | 0.85–0.88 | 1.31 | 1.16 | 1.14 | 85.6 | 80.8 | 81.3 |
| 7 | Blue Black | 0.86–0.92 | 1.35 | 1.27 | 1.22 | 85.6 | 81.8 | 83.5 |
| 8 | Blue Black | 0.85–0.90 | 1.33 | 1.25 | 1.20 | 85.4 | 82.1 | 83.3 |
| 9 | Blue Black | 0.84–0.92 | 1.32 | 1.23 | 1.17 | 85.6 | 82.3 | 83.0 |
| 10 | Blue Black | 0.84–0.93 | 1.36 | 1.27 | 1.23 | 85.5 | 81.5 | 83.3 |
| 11 | Blue Black | 0.82–0.90 | 1.33 | 1.24 | 1.20 | 85.3 | 81.6 | 83.5 |
| 12 | Blue Black | 0.81–0.89 | 1.32 | 1.24 | 1.19 | 85.6 | 82.1 | 83.3 |
| 13 | Blue Black | 0.82–0.90 | 1.34 | 1.26 | 1.20 | 85.2 | 81.4 | 83.1 |
| 14 | Blue Black | 0.83–0.91 | 1.33 | 1.24 | 1.17 | 85.5 | 81.7 | 83.0 |
| 15 | Blue Black | 0.82–0.91 | 1.34 | 1.26 | 1.21 | 86.3 | 82.5 | 84.1 |
| 16 | Blue Black | 0.87–0.93 | 1.35 | 1.31 | 1.26 | 85.2 | 81.7 | 83.5 |
| Comparative Examples | | | | | | | | |
| 1 | Blue Black | 0.64–0.92 | 1.34 | 1.25 | 1.22 | 85.5 | 81.9 | 83.6 |
| 2 | Blue Black | 0.72–0.78 | 1.23 | 1.16 | 1.07 | 82.1 | 73.4 | 79.3 |
| 3 | Blue Black | 0.83–0.86 | 1.25 | 1.05 | 0.96 | 81.7 | 69.5 | 72.5 |
| 4 | Black | 0.70–0.83 | 1.27 | 1.13 | 1.03 | 84.2 | 79.5 | 82.2 |
| 5 | Blue | 0.78–0.90 | 1.25 | 1.04 | 1.07 | 81.1 | 74.3 | 77.5 |
| 6 | Green Black | 0.75–0.82 | 1.27 | 1.14 | 1.05 | 80.5 | 61.2 | 68.4 |

As shown in Table 1, each of the heat-sensitive recording materials according to the present invention has a PCS value of 0.8 or more at 600–700 nm, and develops a clear blue-black color image. Further, both of the color density of the recorded images and the whiteness of the recording surface of the heat-sensitive recording according to the present invention are stably maintained at a high value even if they are allowed to stand for a long time under the condition of high temperature or high humidity.

What is claimed is:

1. A heat-sensitive recording material having on a base sheet a heat-sensitive recording layer which comprises a colorless or pale colored basic chromogenic material and a color developer, characterized in that the recording layer comprises at least one fluoran derivative developing a black color and at least one azaphthalide derivative represented by the formula (I) as the basic chromogenic material, and at least one diphenylsulfone derivative represented by the formula (II) as the color developer, the amount of the azaphthalide derivative being within the range of 3 to 50% by weight based on the amount of the fluoran derivative:

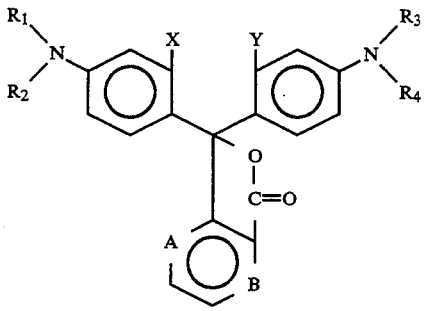

(I)

in which each of A and B is carbon or nitrogen atom, but at least one of them is nitrogen atom; each of $R_1$, $R_2$, $R_3$ and $R_4$ is hydrogen, alkyl, unsaturated alkyl, cycloalkyl, aryl, aralkyl or tetrahydrofurfuryl, the aryl and aralkyl may be substituted by at least one substituent selected from the group consisting of halogen, alkyl and alkoxyl, and $R_1$ and $R_2$, or $R_3$ and $R_4$ may form a ring with the neighboring nitrogen atom; each of X and Y is hydrogen, halogen, alkyl, alkoxyl or acyloxy, but both of X and Y are not hydrogen atom;

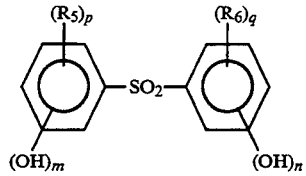

(II)

in which each of $R_5$ and $R_6$ is $C_1$–$C_4$ alkyl, $C_2$–$C_4$ alkenyl, $C_1$–$C_4$ alkoxyl, benzyloxy or halogen atom, m is 0, 1 or 2, n is an integer of 1 to 3 and each of p and q is 0, 1 or 2.

2. A heat-sensitive recording material according to claim 1, wherein the diphenylsulfone derivative is 2,4'-dihydroxydiphenylsulfone or 4-hydroxy-4'-isopropoxydiphenylsulfone.

3. A heat-sensitive recording material according to claim 1, wherein the azaphthalide derivative is 3,3-bis(4-diethylamino-2-ethoxyphenyl) -4-azaphthalide, 3,3-bis(4-diethylamino-2-methoxyphenyl)-4-azaphthalide, 3-(4-dimethylaminophenyl)-3-(4-diethylamino-2-methylphenyl) -4-azaphthalide, 3,3-bis(4-dibutylamino-2-methoxyphenyl)-4-azaphthalide, 3-(4-diethylaminophenyl)-3-(4-dimethylamino-2-chlorophenyl) -7-azaphthalide, 3,3-bis(4-N-ethyl-p-toluidino-2-methoxyphenyl) -4-azaphthalide, 3-(4-dibenzylaminophenyl)-3-(4-diethylamino -2-ethoxyphenyl)-4-azaphthalide or 3-(4-dimethylaminophenyl) -3-(4-diethylamino-2-hexyloxylphenyl)-4-azaphthalide.

* * * * *